United States Patent [19]

Mattei et al.

[11] Patent Number: 4,598,719

[45] Date of Patent: Jul. 8, 1986

[54] CIGARETTE MANUFACTURING MACHINE

[75] Inventors: Riccardo Mattei, Bologna; Bruno Belvederi, S. Martino di Monte San Pietro, both of Italy

[73] Assignee: G. D Societa' Per Azioni, Bologna, Italy

[21] Appl. No.: 608,025

[22] Filed: May 7, 1984

[30] Foreign Application Priority Data

May 27, 1983 [IT] Italy ..... 3439 A/83

[51] Int. Cl.[4] ..... A24C 5/18; A24C 5/28; A24C 5/34

[52] U.S. Cl. ..... 131/84.1; 131/906; 131/908; 131/65

[58] Field of Search ..... 131/84 R, 84 BC, 84.2, 131/84.3, 84.4, 908, 906, 910, 60, 65

[56] References Cited

U.S. PATENT DOCUMENTS 4,459,998 7/1984 Cabbe et al. ..... 131/84 R
4,463,766 8/1984 Arthur et al. ..... 131/84 R

*Primary Examiner*—Vincent Millin
*Assistant Examiner*—H. Macey
*Attorney, Agent, or Firm*—Marshall, O'Toole, Gerstein, Murray & Bicknell

[57] ABSTRACT

Cigarette manufacturing machine on which a continuous strip of paper is fed, through a tobacco loading station and along a guide for forming a continuous rod, to a crosswise cutting device by a conveyor belt driven by a drive roller driven, together with the cutting device, by a motor via a differential assembly controlled by a detector which measures the travelling speed of the cigarettes.

4 Claims, 4 Drawing Figures

CIGARETTE MANUFACTURING MACHINE

BACKGROUND OF THE INVENTION

The present invention relates to a cigarette manufacturing machine.

Cigarette manufacturing machines are known to produce a continuous cigarette rod by feeding a continuous strip of paper, on a conveyor belt, through a loading station where the said strip of paper is loaded with a continuous stream of shredded tobacco.

Together, the paper and tobacco are then fed by the said conveyor through a guide for forming the rod, the said guide generally being defined by a surface along which to run the conveyor, the shape of the said surface first changing from flat to concave in the crosswise direction in relation to the travelling direction of the conveyor, then to cylindrical, thus forcing the said strip of paper to wrap crosswise round the said stream of tobacco.

The continuous rod thus formed is then fed through a crosswise cutting device which cuts the continuous rod at a constant preset rate to form cigarettes or cigarette pieces. On the abovementioned known types of manufacturing machines, the said conveyor belt and the said cutting device are usually driven by a single motor in view of the importance of providing for an extremely precise relationship between the operating speed of the cutting device and the travelling speed of the continuous rod. In fact, if the speed of the cutting device remains constant, any increase or reduction in the travelling speed of the continuous rod in relation to the correct required speed would automatically result in the cigarettes being lengthened or shortened respectively in relation to the required length.

On the abovementioned known types of manufacturing machines, one perfect relationship between the speed of the cutting device and the travelling speed of the rod is usually unachievable on account of the conveyor belt. The latter usually comprises a number of transmission rollers, a drive roller, connected to the said motor, and a belt which is wound round the said rollers and is the main reason for any inaccuracy in the length of the cigarettes produced on the machine. The reason for this is that the dynamic behaviour of different belts is never the same and, more important, even the dynamic behaviour of a single belt changes with time.

Consequently, notwithstanding constant speed on the drive roller, the travelling speed of the belt may vary over time thus resulting in changes to the length of the cigarettes produced on the machine.

SUMMARY OF THE INVENTION

The aim of the present invention is to provide a cigarette manufacturing machine designed to overcome the abovementioned drawback.

With this aim in view, the present invention relates to a cigarette manufacturing machine comprising a top, a conveyor belt extending along at least part of the said top and wound round transmission rollers and a drive roller, a loading station through which the said conveyor belt runs for loading shredded tobacco on to a continuous strip of paper resting on the conveyor belt itself, guide means through which the said conveyor belt runs downstream from the said loading station for wrapping the said paper strip round the said tobacco so as to form a continuous cigarette rod, a cutting device designed to cut the said continuous rod crosswise into pieces, and a motor for driving the said cutting device and the said drive roller, characterised by the fact that the said drive roller is connected to the said motor via a differential assembly; the latter having an output connected to the said drive roller, a first input connected to the said motor, and a second input; measuring means being provided for controlling the speed and, therefore, the length of the said pieces, and actuating means controlled by the said measuring means being connected to the said second input for maintaining an output signal from the said measuring means constantly equal to a reference signal.

BRIEF DESCRIPTION OF THE DRAWINGS

Further characteristics and advantages of the present invention will now be described with reference to the attached drawings showing a number of non-limiting arrangements and in which.

DETAILED DESCRIPTION OF THE INVENTION

Figure 1:
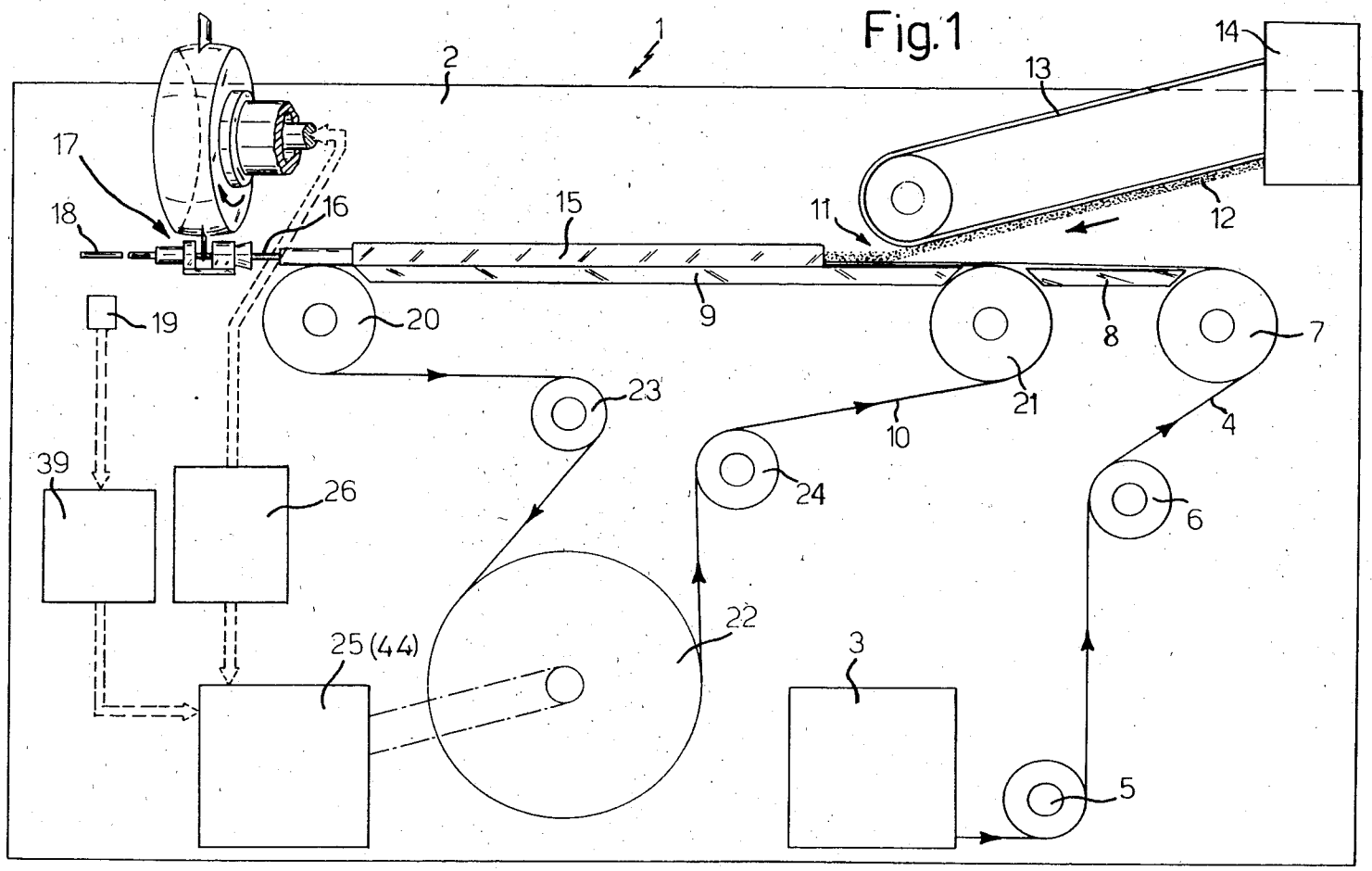
FIG. 1 shows a part view of a cigarette manufacturing machine according to the present invention.

Number 1 in FIG. 1 indicates a cigarette manufacturing machine comprising a bed (2) supporting a device (3) for feeding a continuous strip (4) of cigarette paper.

When it comes out of device 3, strip 4 is guided by three guide rollers (5, 6, 7) on to an essentially horizontal top (8) resting in a fixed position on bed 2.

Downstream from top 8, in the travelling direction of strip 4, provision is made for a second horizontal top (9) lying essentially in the same plane as top 8 and supporting the upper branch of conveyor belt 10.

As it moves along top 9, strip 4 moves through a loading station (11) where it is loaded with a continuous stream (12) of shredded tobacco by a suction type conveyor belt (13) coming out of a known type of feed unit (14).

Downstream from loading station 11, strip 4 engages a guide means (15) having a curved section (not shown) with a gradually decreasing curve radius and terminating, in known manner, in an essentially cylindrical end section. In this way, strip 4 is forced to wrap round the relative stream (12) of tobacco in known manner so as to form a continuous cigarette rod (16).

As it comes off top 9, rod 16 is fed through a known type of cutting device (17) which cuts it into pieces or cigarettes (18) the respective speed and length of which are detected continuously by measuring means comprising a detecting means (19) constituting a device for emitting signals depending on the speed of pieces 18.

As shown in FIG. 1, belt 10 winds round two transmission rollers (20, 21), arranged at opposite ends of top 9, and a drive roller (22).

Between rollers 20 and 22 and between the latter and roller 21, belt 10 winds clockwise round transmission roller 23 and tensioning roller 24 respectively.

Via differential assembly 25, roller 22 is driven by motor 26 which also drives cutting device 17.

Figure 2:
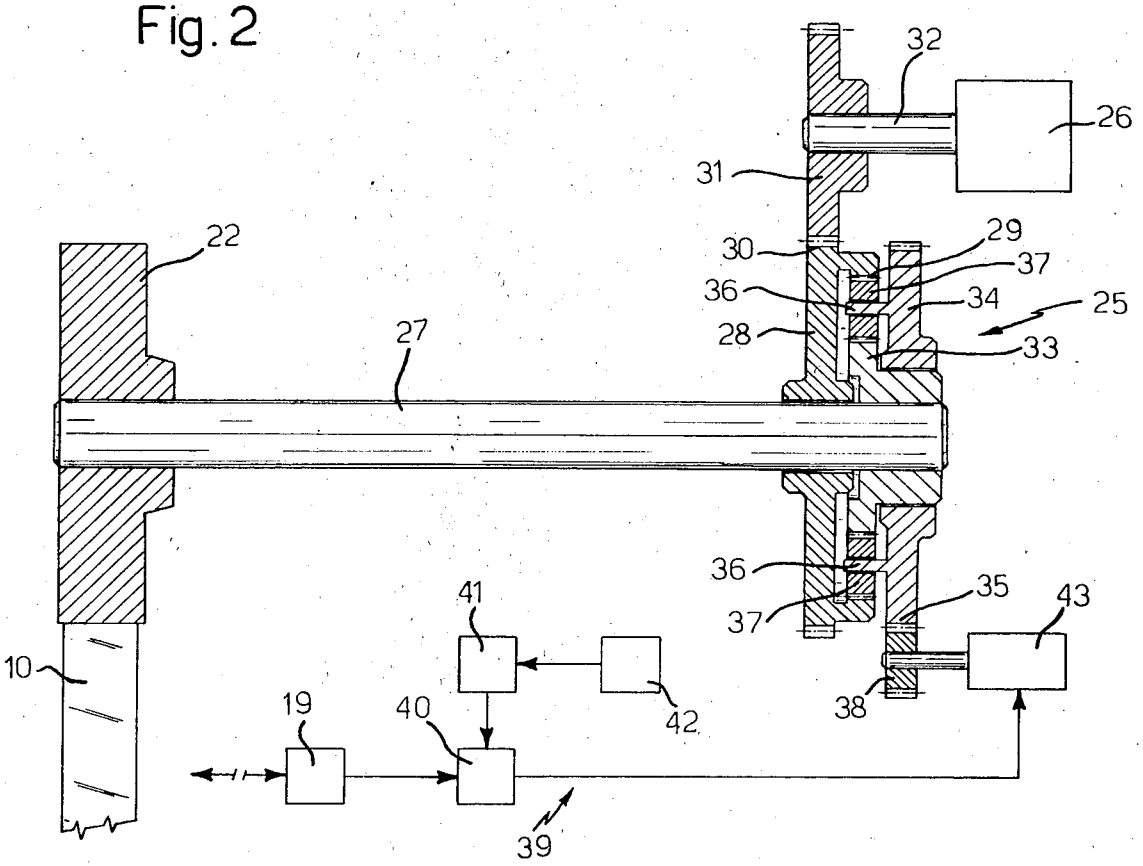
FIG. 2 shows a part section, part block diagram of a preferred arrangement of a detail in FIG. 1.

As shown in FIG. 2, differential assembly 25 comprises an output consisting of a shaft (27) fitted at one end with roller 22 and idly supporting, close to the other end, a disc (28) constituting a first input of differential 25 and on the outer contour of which are formed an internal ring gear (29) and external teeth (30) meshing with a gear (31) on output shaft 32 of motor 26.

Shaft 27 is also fitted with a sun gear (33) supporting in rotary manner a train carrier (34) coaxial with it and provided with external peripheral teeth (35) and constituting a second input of differential 25. Train carrier 34 supports two peripheral axial pins (36) arranged diametrically opposite and each fitted in rotary manner with a planet gear (37) between sun gear 33 and ring gear 29. Teeth 35 mesh with gear 38 constituting the output of control unit 39 the input of which consists of measuring means comprising detecting device 19. Control unit 39 comprises a comparing means (40) a first input of which is connected to the output of an emitter (41) for emitting a reference signal which may be modified as required via varying means 42, and a second input of which is connected to the output of detector 19. Comparator 40 is designed to emit an output signal for controlling actuating means comprising a motor (43), preferably of the step-by-step type, the output shaft of which is fitted with gear 38. In use, the speed and, therefore, the length of the cigarettes (18) coming off cutting device 17 are measured by detector 19. The signals emitted by the latter are compared by comparator 40 with the reference signal coming from emitter 41 and relative to a preset required cigarette length.

If, at any time, a discrepancy exists between the said reference signal and the signal emitted by detector 19, the comparator (40) detecting the said discrepancy emits a corresponding error signal which activates motor 43 for eliminating the error.

If, for example, detector 19 finds cigarettes 18 are shorter than they should be owing to the fact that, with cutting device 17 working at constant speed, strip 4 is being fed by belt 10 and, consequently, roller 22 at less than the required speed, motor 43 is activated so as to accelerate roller 22 and rectify the length of cigarettes 18 via differential assembly 25 operation of which needs no explanation.

The possibility of acting on emitter 41 by means of variator 42 provides for altering the length of cigarettes 18 by simply varying the intensity of the reference signal emitted by emitter 41.

Figure 3:
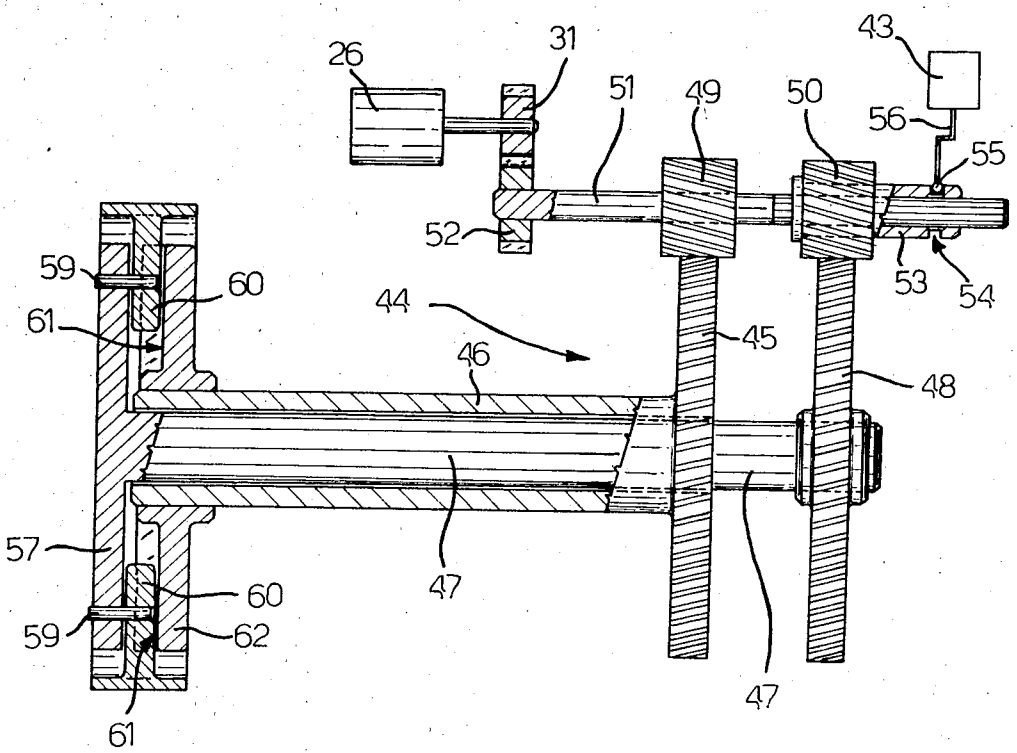
FIG. 3 shows a part section of a variation of the FIG. 2 arrangement.
Figure 4:
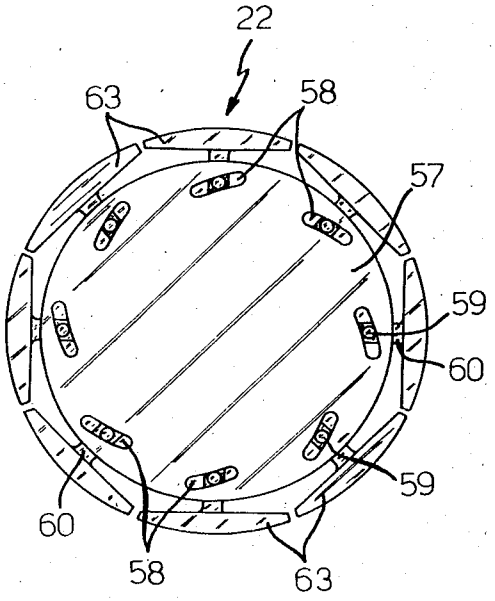
FIG. 4 shows a front view of a detail in FIG. 3.

In the variation shown in FIG. 3, differential assembly 25 in FIG. 2 is replaced by differential assembly 44 which comprises a first helical gear (45) constituting a first input of differential 44 and integral with one end of a tubular coupling or hollow shaft (46) mounted idly on to a centre shaft (47) constituting the output of differential 44.

The end of shaft 47 projecting from coupling 46, on the side relative to gear 45, is fitted with a second helical gear (48) identical with gear 45 and constituting a second input of differential 44. Gears 45 and 48 engage the teeth of respective gears 49 and 50, the former assembled in fixed manner and the latter in sliding but angularly fixed manner on to shaft 51 fitted with gear 52 connected to output gear 31 of motor 26. In more detail, gear 50 is fitted on to coupling 53 connected to shaft 51 by a splined coupling having an annular external groove (54) engaged by a tappet (55) fitted on to the end of an output crank (56) on motor 43.

The end of shaft 47, opposite the one carrying gear 48, is connected to a disc (57) having a number of spiral-shaped slots (58) each of which is fitted inside, in crosswise sliding manner, with a respective pin (59) parallel to the axis of shaft 47.

Each of pins 59 is integral with a mid point on a respective rod (60) assembled in sliding manner inside a respective radial slot (61) on an end surface of disc 62 arranged facing disc 57 and fitted on to the end of coupling 46 opposite the end carrying gear 45. The outer ends of rods 60 are fitted with respective sectors (63) defining roller 22. Unlike differential assembly 25 which varies the speed of roller 22, differential assembly 44 varies its diameter and, consequently, surface speed by varying the angular position of disc 62 in relation to disc 57 and, therefore, the position of pins 59 inside respective slots 58 so as to move sectors 63 radially one way or the other.

We claim:

1. A cigarette manufacturing machine comprising a top;

first and second motors;

a plurality of rollers one of which is driven by said first motor;

a conveyor belt extending along at least part of said top and wound around said rollers, said driven roller being a driving roller for said conveyor belt;

a tobacco loading station through which said conveyor belt extends, shredded tobacco being loaded at said station on to a continuous strip of paper resting on said conveyor belt;

guide means arranged downstream from said loading station and through which said conveyor belt extends, said guide means engaging said conveyor belt to wrap said strip of paper resting thereon about said tobacco to form a continuous cigarette rod;

a cutting device driven by said first motor to cut said continuous rod crosswise into pieces;

and a differential assembly connecting said first and second motors to said driving roller, said assembly comprising:

first and second rotary input members and a rotary output member;

said rotary output member being coupled to said driving roller for rotation therewith, said first rotary input member being coupled to said first motor;

said second rotary input member being coupled to said second motor;

and measuring means to measure the advancement speed of said continuous cigarette rod and to control said second motor so as to maintain an output signal from said measuring means constantly equal to a reference signal.

2. A machine as claimed in claim 1, wherein said rotary output member comprises a main shaft to which said driving roller is rigidly connected.

3. A machine as claimed in claim 2, wherein said first rotary input member comprises a second shaft, said driving roller comprising a center disc fitted onto said main shaft and a plurality of sectors mounted on said disc for rotation therewith about the axis of said main shaft, and for radial movement relative to said disc;

said second shaft being coupled to said sectors to control said radial movement thereof;

and said sectors defining the periphery of said driving roller in contact with said conveyor belt.

4. A machine as claimed in claim 1, wherein said measuring means comprises a detector emitting a signal depending on the speed of said continuous cigarette rod, an emitter producing an adjustable reference signal, and a comparator for comparing said speed signal with said reference signal and for emitting an error signal controlling said second motor.

* * * * *